United States Patent [19]

Jonsson et al.

[11] 4,446,661

[45] May 8, 1984

[54] SPACER MEANS FOR PROVIDING AIR GAPS

[76] Inventors: Jan U. E. Jonsson, Hantverksvägen 8, 184 00 Åkersberga; Rolf B. J. R. Blomgren, Lövängsvägen 131, 183 00 Täby; Nils H. Edlund, Nybygget Sandemar, 130 54 Dalarö, all of Sweden

[21] Appl. No.: 198,143

[22] PCT Filed: Feb. 12, 1980

[86] PCT No.: PCT/SE80/00042

§ 371 Date: Oct. 7, 1980

§ 102(e) Date: Oct. 7, 1980

[87] PCT Pub. No.: WO80/01702

PCT Pub. Date: Aug. 21, 1980

[30] Foreign Application Priority Data

Feb. 19, 1979 [SE] Sweden ..... 7901454

[51] Int. Cl.[3] ..... E04B 1/00

[52] U.S. Cl. ..... 52/95; 52/407

[58] Field of Search ..... 52/95, 199, 303, 407, 52/799, 406

[56] References Cited

U.S. PATENT DOCUMENTS

| | | | |
|---|---|---|---|
| 1,963,609 | 6/1934 | Balduf et al. | 52/481 X |
| 2,148,496 | 2/1939 | Park | 52/407 X |
| 2,330,941 | 10/1943 | Acuff, Jr. | 52/406 X |
| 2,786,004 | 3/1957 | Schwartz et al. | 52/406 |
| 3,165,791 | 1/1965 | Valsvik | 52/407 |
| 3,313,072 | 4/1967 | Cue | 52/303 |
| 3,683,785 | 8/1972 | Grange | 52/199 X |
| 3,797,180 | 3/1974 | Grange | 52/95 |

*Primary Examiner*—Carl D. Friedman

*Attorney, Agent, or Firm*—Birch, Stewart, Kolasch & Birch

[57] ABSTRACT

The invention relates to a sheet formed as a spacer means for creating air gaps, e.g. between roofing insulation and a roof. The sheet (1) is corrugated and is resiliently compressible transverse to the longitudinal direction of the corrugations (7,8).

3 Claims, 7 Drawing Figures

SPACER MEANS FOR PROVIDING AIR GAPS

The present invention relates to a sheet formed as a spacer means for providing air gaps between roofs or ceilings and insulation by providing the sheet with corrugations. A distinguishing feature of the present invention is that the sheet is resiliently compressible transverse to the longitudinal direction of the corrugations.

In the construction of well-insulated buildings, problems often occur with ventilating well-insulated surfaces. If the ventilation is insufficient, e.g. between roofing panels and roof insulation, damage due to dampness, such as rot, readily occurs. As a result, dampness can also remain in the insulation, with resulting deterioration. If the amount of ventilation provided is too great, on the other hand, the air current above the insulation will have a cooling effect. It is therefore of great importance to provide for controlled ventilation.

At the present time, strips are used for creating air gaps, these strips having the cross-sectional dimensions of at least 25×25 mm, and they are nailed to each roof truss or the like, a further strip usually being attached in the middle of the first strips. The insulation is protected from air movement, e.g. by sheathing felt or by asphalt-impregnated wood fibre boards being attached to the battens. This solution has several disadvantages however, of which the following can be mentioned:

1. The gap must be built up with the aid of battens, nails and protective material.

2. If there is any variation, e.g. of the roof truss spacing, the protective material must be cut to different dimensions.

3. If the battens are not set up properly, the insulation can force out the protective material, thereby preventing air circulation.

4. Setting up battens and boards in roofing is very time-consuming and difficult, due to inconvenient working attitudes and scaffolding.

With the aid of the present invention, it is intended to solve the problem of creating air gaps without the disadvantages occurring, which have been described above.

The sheet formed as a spacing means in accordance with the invention consists of a corrugated sheet which is manufactured in a material which is not sealed against diffusion, in sizes of 1.200×2.100 mm, for example, and which can be cut to a suitable format and fastened between roof trusses or the like. The sheet formed as a spacer means includes an angularly shaped resilient portion, a contact surface for the insulation, a contacting edge for the outer surface of a roofing panel, for example, and a seal against supporting members, e.g. roofing beams. Erecting, fitting and sealing is achieved by the sheet being cut in its expanded state thereafter, it is pressed together and inserted between the main roofing members. When the sheet subsequently expands, it will both seal and itself against the roofing members.

The invention will now be described in detail, with reference to the attached drawings, where FIG. 1 illustrates the sheet formed as a spacer means, and fitted against a roofing panel;

Figure 1:
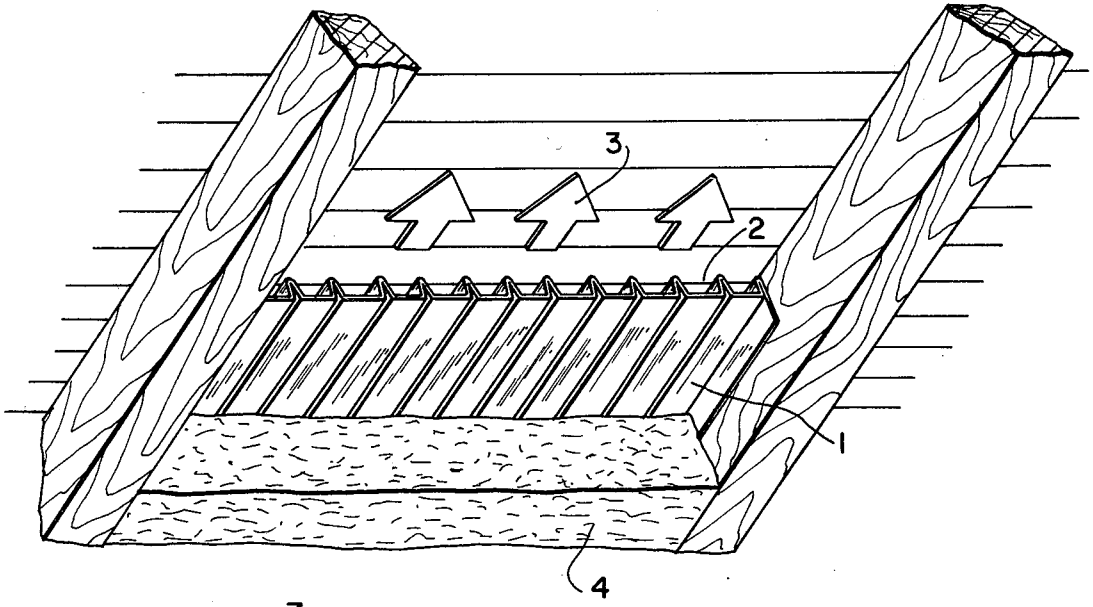
Figure 2:
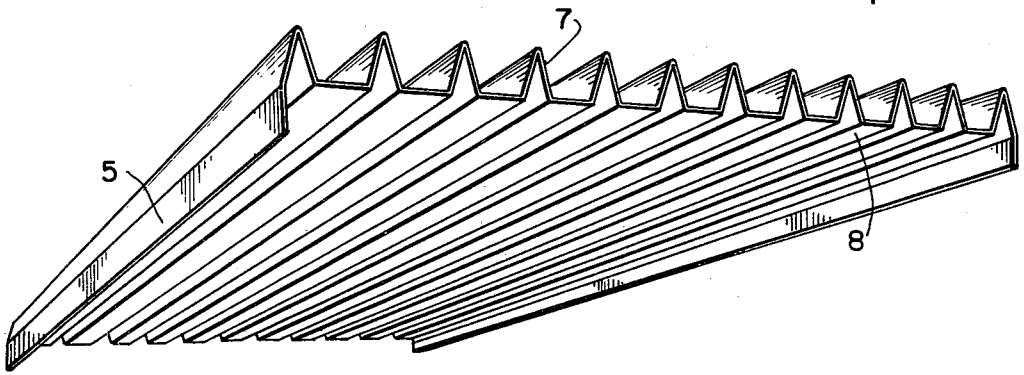
FIG. 2 is a view of the sheet formed as a spacer means.
Figure 3:
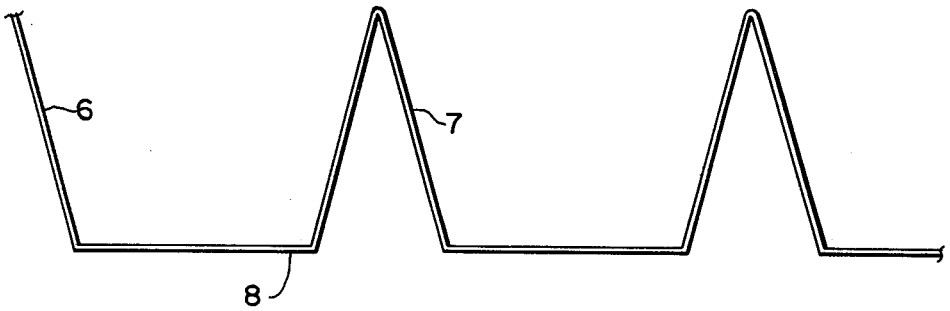
FIGS. 3 and 4 are detail sections showing the spacer means when loose (expanded) and when fitted (compressed)
Figure 4:
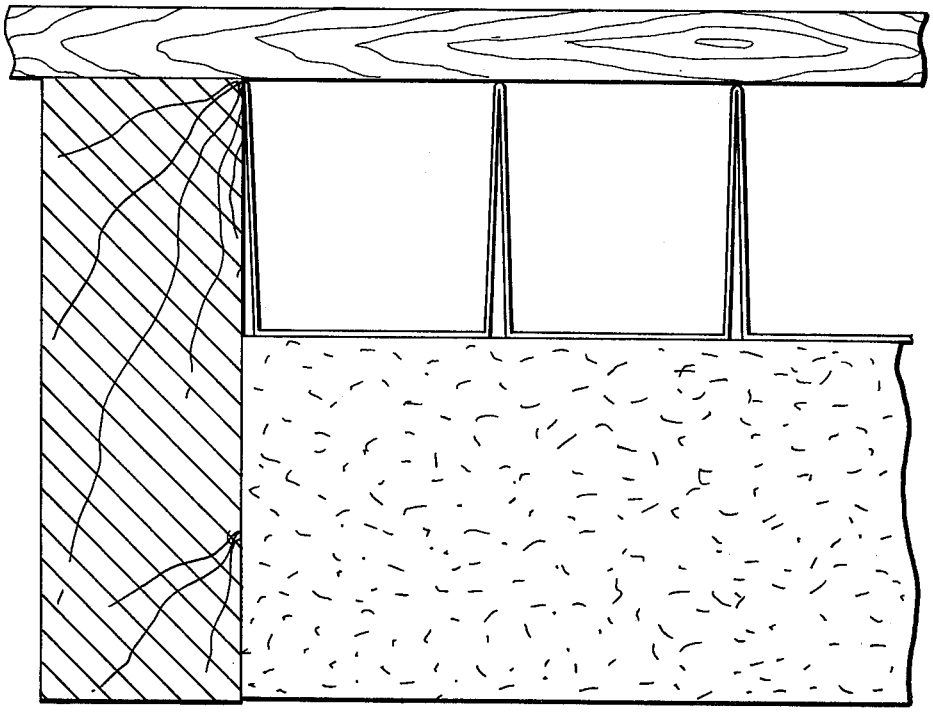
Figure 5A:
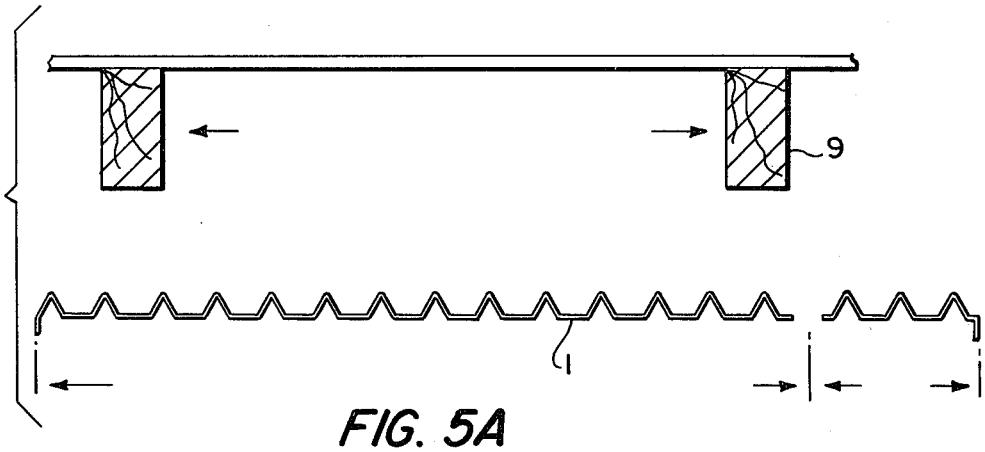
FIGS. 5*a, b* and *c* illustrate in cross section a proposal as to how the spacer means can be inserted between adjacent roofing panels.
Figure 5B:
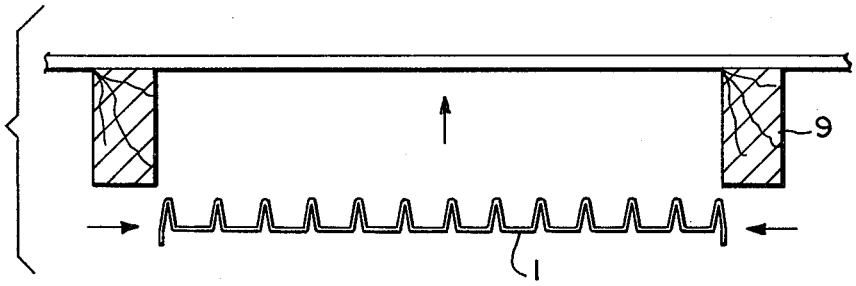
Figure 5C:
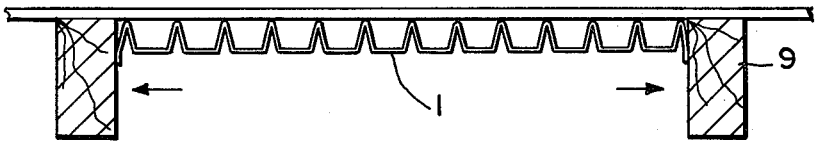

The fitted sheet formed as spacer means (1) in FIG. 1 illustrates how air circulation channels (2) are formed, said channels giving a desired air circulation (3) while the insulation (4) is also given good wind protection. The embodiment according to FIG. 2 illustrates a sheet formed as spacer means in an uncompressed condition, and provided with extended outer flaps (5) which can be attached to the battens, or, if insulation and the sheet formed as distance means are erected simultaneously said flaps can enclose the edges of the insulation and thereby facilitate insertion between the battens or support members. In the embodiment according to FIGS. 3 and 4, these flaps (5) are lacking, the terminating seal only comprising a resilient portion (6) of the corrugation. Resilient movements of the sheet formed as a spacer means are provided with the aid of angularly shaped crests (7) in the corrugations, which allow the means to be pressed together transverse to the longitudinal direction of said ridges when the means is fitted. Since the resilient portions (7) are connected to flat base portions (8), a flat cohesive contact surface facing the insulation is thus formed.

For fitting, the sheet (1) is cut in its extended or uncompressed condition (5*a*), and is given a size such that it can accommodate possible deviations in spacing between the supporting members (9). The sheet (1) is subsequently pressed together and inserted between said members, and through its resilient action it will both seal and fit between the members. Insulation is subsequently applied in a conventional manner.

The invention is naturally not limited to the embodiment shown and can be varied within the scope of the accompanying patent claims.

We claim:

1. A spacer means for providing air gaps between a roof or ceiling and its insulation and having sufficient rigidity to support said insulation thereon comprising a sheet provided with corrugations which extend substantially the entire thickness of said air gaps, said sheet being formed so as to be resiliently compressible transverse to the longitudinal direction of said corrugations, whereby the spacer means is readily adjustable to fit a preexisting insulation without the necessity of being permanently fixed to structural members of said installation, and wherein the corrugations in their relaxed state are formed with alternate flat base portions and angular portions, united therewith, such that when the angular portions are compressed together, the sheet can be placed in its position of use between two roofing beams, while the flat base portions form a flat interconnecting surface to which an insulating layer can be applied, said compression of the corrugations transforming the sheet from a discontinuous surface of peaks and valleys to a substantially continuous surface.

2. The spacer means as claimed in claim 1, wherein the longitudinal sides of the sheet terminate with an angularly formed portion having an outer extended flap.

3. The spacer means as claimed in claim 2 wherein the sheet is made of a material which is not sealed against diffusion.

* * * * *